United States Patent [19]

Baldwin

[11] 4,387,515

[45] Jun. 14, 1983

[54] BOWLING SHOE PROTECTOR

[76] Inventor: Darwin E. Baldwin, 9721 Andersonville Rd., Clarkston, Mich. 48016

[21] Appl. No.: 199,480

[22] Filed: Oct. 22, 1980

[51] Int. Cl.[3] ..... A43B 3/10; A43B 5/00

[52] U.S. Cl. ..... 36/7.5; 36/130; 36/135

[58] Field of Search ..... 36/135, 130, 7.5, 7.6, 36/11.5

[56] References Cited

U.S. PATENT DOCUMENTS

| | | | |
|---|---|---|---|
| 988,159 | 3/1911 | Wiltse | 36/7.1 |
| 1,644,217 | 10/1927 | Wreford | 36/7.1 |
| 2,372,501 | 3/1945 | Lawrence | 36/135 |
| 2,449,936 | 9/1948 | Glasgow | 36/7.1 |
| 2,799,951 | 7/1957 | Rogers | 36/7.1 |
| 2,986,823 | 6/1961 | Kos | 36/7.1 |
| 3,399,470 | 9/1968 | Schofield | 36/7.1 |
| 3,898,750 | 8/1975 | Epstein . | |
| 3,913,243 | 10/1975 | Arnold et al. | 36/135 |
| 4,023,281 | 3/1977 | Terry | 36/7.1 |
| 4,055,005 | 10/1977 | Meinhart | 36/135 |
| 4,083,124 | 4/1978 | Michalak | 36/7.1 |

*Primary Examiner*—Patrick D. Lawson

*Attorney, Agent, or Firm*—Gifford, VanOphem, Sheridan & Sprinkle

[57] ABSTRACT

A bowling shoe protector comprising a thin, slightly flexible sole having an enlarged, generally foot-shaped configuration, and a single support strap secured at the longitudinal center of the sole. The strap includes a hook and pile connector so that the strap can form a loop which receives a shoe and secures the shoe to the sole of the protector. The sole preferably includes a pair of small raised peripheral wall portions to prevent displacement of the shoe past the periphal edge of the shoe protector.

10 Claims, 2 Drawing Figures

BOWLING SHOE PROTECTOR

BACKGROUND OF THE INVENTION

1. Field of the Invention

The present invention relates generally to a shoe protector which covers the bottom surface of the shoe and, more particularly, to such a protector having a sole protecting pad with a single adjustable loop secured thereon for easy insertion and extraction of a bowling shoe therein.

2. Description of the Prior Art

It is well known that bowling shoes are constructed so that the floor engaging surface of the shoes gives the bowler control during his approach to the foul line of the bowling lane. Typically the final step of a bowler's approach is a sliding step whereby the shoe must slide across the finished surface of the approach. Typically, a right-handed bowler would slide his left foot toward the foul line as a final step before releasing the bowling ball toward the pins. Thus, the sole of the bowler's left shoe is made of leather or some other material which permits the shoe to be slid across the finished surface of the approach. On the other hand, the sole of the bowler's right shoe can be made of rubber or some other material which permits the shoe to frictionally engage the bowling lane. In order to perform their intended functions, the soles of the bowling shoe must remain dry. If the sole of the sliding shoe becomes wet, it will stick on the approach which can cause injury to the bowler and will certainly cause the ball to be improperly released. During the winter or wet season this is a particularly troublesome problem because snow and/or water will be tracked into the establishment and unless care is taken will be stepped into by bowlers.

Although many types of overshoes or shoe protectors are known, they are not well adapted for use in a bowling alley where the bowler must repeatedly advance to and depart from the bowling lane. For example, one previously known type of shoe covering comprises a single piece of flexible and preferably a plastic material foled to form an opening in which a shoe can be inserted. The opening can be provided with an elastic band so that the covering remains secured over the entire shoe. Although, this type of shoe covering is well adapted for use by medical persons in an operating room to prevent a transfer of harmful bacteria and the like from the operating room to other areas by contact with the street shoes worn by such personnel, it would be tedious and time consuming to repeatedly remove and don this type of convering from a bowling shoe as would be necessary each time the bowler approached and departed from the bowling lane.

SUMMARY OF THE PRESENT INVENTION

The present invention provides a bowling shoe protector which is especially adapted to be used with bowling shoes since it can be easily attached and removed from the bowling shoe at will by the bowler. The bowling shoe protector generally comprises a substantially flat sole plate appropriately configured to cover substantially the entire bottom surface of a bowling shoe. The plate is preferably made of plastic but can be made of any material which is rigid enough to retain its shape but flexible enough to bend and conform with the sole of the bowling shoe as the bowler walks and which resists the absorption of liquids such as spilled beverages, melting snow, rain or the like. A pair of guide walls extend upwardly from the upper surface of the plate for a short distance along the edge of opposing sides of the front portion of the plate. A single adjustable strap is secured across the center of the plate. The strap is preferably flexible and preferably includes a hook and pile type fastening means at its end. In addition, the strap can be at least partially elastic so that the strap can be snugly but releasably secured about the bowling shoe without repeated actuation of the fastening means.

Thus, the present invention provides a bowling shoe protector which is simple and thus quite inexpensive to produce. At the same time, it is highly efficient for use in a bowling alley since the protector can be easily installed and removed from the bowling shoe with a minimum of effort on the part of the bowler. The sole can be large enough to accommodate several sizes of bowling shoes. Nevertheless, when the bowler departs from the lane, the protector is easily installed and protects the bottom surface of the bowling shoe from spilled beverages, snow or rain around the bowling alley premises.

BRIEF DESCRIPTION OF THE DRAWING

The present invention will be better understood with reference to the following detailed description of a preferred embodiment of the present invention when read in conjunction with the accompanying drawing in which like reference characters refer to like parts in the views and in which.

DETAILED DESCRIPTION OF A PREFERRED EMBODIMENT OF THE PRESENT INVENTION

Figure 1:
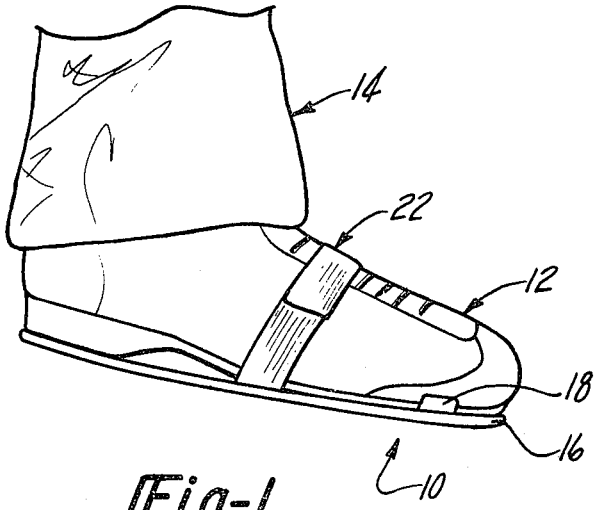
FIG. 1 is a side plan view of the bowling shoe protector according to the present invention installed on a bowling shoe.

Referring now to FIG. 1, the bowling shoe protector 10 of the present invention is thereshown installed on a bowling shoe 12 worn by a bowler 14. The protector comprises a substantially flat sole 16 having a wide forward portion 20 and a narrower heel portion 17. In addition, raised peripheral wall portions 18 and 19 are disposed on opposite sides of the toe portion 20 of the shoe 12. A strap 22 is secured to the center of the sole 16 so that it can be wrapped around the shoe 12 as shown in FIG. 1.

Figure 2:
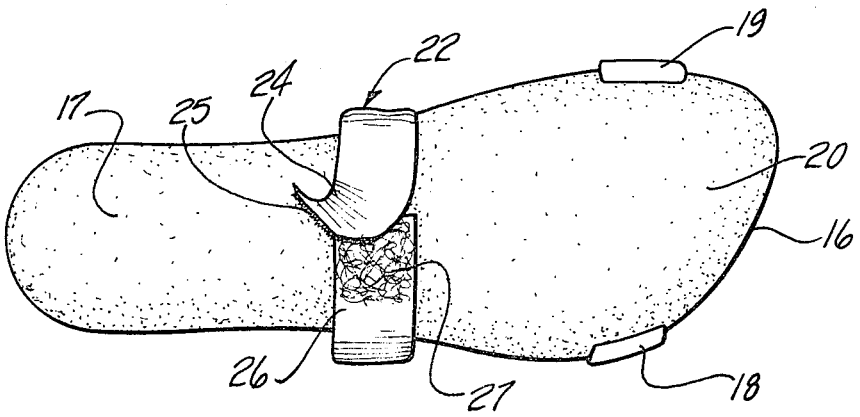
FIG. 2 is a top plan view of the bowling shoe protector shown in FIG. 1.

As shown in FIG. 2, the sole 16 is configured so as to provide protection for the entire bottom of the bowling shoe 12, including the raised portion of the sole intermediate the ball and heel portions of the shoe. Although bowling shoes are available in a wide variety of sizes, the sole 16 can be configured to cover several sizes of bowling shoe within a certain range. This is made possible by the fact that the peripheral wall portions 18 and 19 need not continually engage the sides of the shoe 12. Rather, the heel portion 17 is made wide enough to permit the heel of the shoe to remain on the sole 16 when the shoe is pivoted about the center of the sole 16 between the peripheral wall portions 18 and 19.

The sole 16 is preferably made of a plastic material so that liquids cannot permeate through it. However, it is to be understood that other materials which resist absorption of liquids and which are rigid enough to retain their shape while permitting the sole to conform with the bending action of the shoe can also be used.

The peripheral wall portions 18 and 19 extend upwardly above the top surface of the sole 16 at opposite sides of the toe portion of the sole 16. The guide wall portions 18 and 19 are disposed at the peripheral edges of the toe portion of the sole 16 regardless of the size of the shoe with which the protector is to be used. Moreover, the length of the wall portions 18 and 19 is substantially less than the longitudinal length of the sole 16.

The strap 22 is secured substantially at the longitudinal center of the sole 16 so as to extend laterally across the sole 16. As shown in the drawing, the strap 22 is a flexible, elastic strap having end portions 24 and 26 of substantially the same length. The end portion 24 includes a plurality of hook members 25 adapted to engage and interlock with a pile of fine fiber loops 27 on end portion 26 of the strap. The length of hooks along the end portion 24 and the length of the pile along the portion 26 can extend substantially along the entire length of each end so that the ends can be overlapped and lockingly engaged with each other to form a loop of any desired diameter which is appropriate to receive any size of bowling shoe. The center of the strap 22 is secured to the sole 16 by sewing, gluing, riveting or the like.

Having thus described the important structural features of the shoe protector of the preferred embodiment of the present invention, the operation of the protector is easily explained. The protector 10 can be placed on the floor or ground surface so that the unconnected ends 24 and 26 of the strap 22 extend outwardly from the side of the plate 16. The bowler can then step into the plate 16 and wrap the ends 24 and 26 of the strap 22 about the shoe so that the ends overlap at the top portion of the shoe as shown in FIG. 1, whereby the plurality of hooks 25 become lockingly engaged with the pile of fiber loops 27 and thereby fasten the plate 16 to the bowling shoe 12.

Since the single strap 22 is substantially centered on the sole 16, the longitudinal ends of the plate engage the sole and heel respectively of the bowling shoe 12. However, since the strap is centered with respect to the sole 16, when the bowler turns or pivots on his foot, the sole is likely to rotate about the center whereby a portion of the lower surface of the bowling shoe could extend over the portion of the sole 16 unless restrained. Consequently, in order to prevent this displacement and disorientation of the shoe with respect to the protector sole 16, which would expose the bottom of the shoe to debris scattered about the floor, the sole 16 is provided with peripheral wall portions 18 and 19 so that the toe portion of the shoe remains entrained between the edges of the plate 16 even when forced to pivot with respect to the sole 16. Moreover, the portion 17 of sole 16 is wide enough to cover the heel of the shoe despite the slight lateral displacement with respect to the sole 16. At the same time, the peripheral edges are small enough such that they do not restrict the use of the sole 16 to a shoe of one particular size.

It is important that the front and rear portions 20 and 17 of the sole 16 are sufficiently wide to keep the bottom surfaces of the shoe protected from the floor surface even though some pivoting between the sole and the shoe does occur within the confines of the peripheral wall portions 18 and 19. Although the shoe becomes increasingly larger towards the upper arch portion of the shoe whereby movement of the shoe past the forward edge of the sole 16 is substantially prevented by engagement of the strap 22 at the upper portion of the shoe, it is conceivable that a post or additional wall portion could be disposed at the forward portion of the sole 16 to avoid inadvertent longitudinal slippage of the shoe with respect to the plate causing exposure of the bottom surface of the shoe.

Once the ends 24 and 26 have been locked together on the upper portion of the shoe to hold the sole 16 on the shoe, the slight elasticity of the strap 22 enables the protector to be easily slid from the shoe without requiring disengagement of the hook and pile locking means at the ends of the strap 22. Moreover, the strap 22 forms a loop which is appropriately sized for replacement on the bowler's shoe by merely sliding the shoe through the loop toward the forward portion of the sole 16. Thus, removal of the protector can be rapidly accomplished when the bowler is ready to bowl by sliding the bowling shoe back out of the loop and applying only slight force to overcome the elastic gripping force of the strap 22. The protector is readily put on again when needed without requiring manipulation of the strap fastening means, by merely sliding the shoe forward through the loop.

Thus, the protector covers the entire bottom surface of the bowler's shoe when installed on the shoe. In addition, the raised wall portions at the peripheral edge of the protector prevent inadvertent displacement of the protector with respect to the shoe which could occur when a bowler pivots on his foot. In addition, the protector is configured for use with a wide variety of shoe sizes.

Having thus described my invention, many modifications thereto will become apparent to those skilled in the art to which it pertains without departing from the scope and spirit of the invention as defined in the appended claims:

What is claimed is:

1. A bowling shoe protector consisting of:

a substantially flat support sole having a peripheral configuration which generally conforms to the lower surface profile of a bowling shoe;

a single strap secured at its center laterally across the sole at substantially the longitudinal center of the sole;

first means for securing the ends of the strap to each other, whereby securing the ends forms a loop into which a shoe can be inserted;

second means for entraining the shoe within the peripheral edges of at least a portion of the sole;

wherein said single strap is the sole means for securing the protector to the shoe;

whereby the bowling shoe protector is freely slidable over said shoe so that the shoe becomes engaged within said loop to secure said protector to said shoe; and whereby the protector is easily removed by being freely slidable over said shoe to disengage said shoe from said loop.

2. The invention as defined in claim 1 wherein said first means comprises a hook and pile type connection wherein one end of said strap includes a plurality of hooks and the othe end of said strap includes a plurality of looped fibers.

3. The invention as defined in claim 1 wherein said second means comprises means for laterally entraining said shoe within the peripheral edges of said sole.

4. The invention as defined in claim 3 wherein said last mentioned means is secured only on the forward portion of the sole.

5. The invention as defined in claim 1 wherein said strap is flexible.

6. The invention as defined in claim 1 wherein said second means comprises a short raised wall portion extending upwardly from the top surface of the sole at opposing edges of said sole.

7. The invention as defined in claim 6 wherein said wall portions are disposed at opposing lateral edges.

8. The invention as defined in claim 7 wherein said opposing lateral edges are on the forward portion of the sole.

9. The invention as defined in claim 1 wherein said strap is elastic.

10. The invention as defined in claim 9 wherein said first means comprises means for adjusting the size of the loop formed by the strap and wherein the elasticity of the strap is the sole means for securing the protector to the shoe when the ends of the strap are secured to each other.

* * * * *